US007435304B2

(12) United States Patent
Choi et al.

(10) Patent No.: US 7,435,304 B2
(45) Date of Patent: Oct. 14, 2008

(54) COATING COMPOSITION, AND METHOD FOR MANUFACTURING HIGH SILICON ELECTRICAL STEEL SHEET USING THEREOF

(75) Inventors: Kyu-Seung Choi, Kyungsangbook-do (KR); Jong-Soo Woo, Kyungsangbook-do (KR)

(73) Assignee: POSCO (KR)

( * ) Notice: Subject to any disclaimer, the term of this patent is extended or adjusted under 35 U.S.C. 154(b) by 823 days.

(21) Appl. No.: 10/519,227

(22) PCT Filed: Nov. 11, 2003

(86) PCT No.: PCT/KR03/02412

§ 371 (c)(1), (2), (4) Date: Dec. 22, 2004

(87) PCT Pub. No.: WO2004/044251

PCT Pub. Date: May 27, 2004

(65) Prior Publication Data

US 2005/0217762 A1 Oct. 6, 2005

(30) Foreign Application Priority Data

| | | |
|---|---|---|
| Nov. 11, 2002 | (KR) | 10-2002-0069646 |
| Nov. 11, 2002 | (KR) | 10-2002-0069647 |
| Nov. 27, 2002 | (KR) | 10-2002-0074325 |
| Nov. 27, 2002 | (KR) | 10-2002-0074326 |
| Nov. 27, 2002 | (KR) | 10-2002-0074328 |
| Nov. 27, 2002 | (KR) | 10-2002-0074329 |

(51) Int. Cl.
*H01F 1/16* (2006.01)
*C09D 1/00* (2006.01)

(52) U.S. Cl. ..... 148/122; 148/113; 148/27; 106/286.2; 106/286.3; 106/286.8; 106/287.1; 106/287.34

(58) Field of Classification Search ..... None
See application file for complete search history.

(56) References Cited

U.S. PATENT DOCUMENTS

| | | | | |
|---|---|---|---|---|
| 2,109,485 | A * | 3/1938 | Ihrig | 428/641 |
| 3,224,909 | A * | 12/1965 | Sixtus et al. | 148/113 |
| 3,423,253 | A | 1/1969 | Ames et al. | |
| 3,634,148 | A | 1/1972 | Shin et al. | |
| 4,073,668 | A | 2/1978 | Wieland, Jr. et al. | |
| 4,773,948 | A | 9/1988 | Nakaoka et al. | |
| 4,904,500 | A * | 2/1990 | Krutenat | 427/248.1 |
| 5,089,061 | A | 2/1992 | Abe et al. | |
| 5,200,145 | A * | 4/1993 | Krutenat et al. | 420/129 |

FOREIGN PATENT DOCUMENTS

| | | | |
|---|---|---|---|
| EP | 1 052 043 | A2 | 11/2000 |
| JP | 56-003625 | A | 1/1981 |
| JP | 62-103321 | A | 5/1987 |
| JP | 62-227032 | A | 10/1987 |
| JP | 62-227078 | A | 10/1987 |
| JP | 5-171281 | A | 7/1993 |
| JP | 2000-045025 | A | 2/2000 |
| JP | 2000-144248 | A | 5/2000 |
| JP | 2000-192204 | A | 7/2000 |
| KR | 10-063069 | B1 | 9/1998 |

* cited by examiner

*Primary Examiner*—John P. Sheehan
(74) *Attorney, Agent, or Firm*—The Webb Law Firm, P.C

(57) ABSTRACT

There are provided a coating composition for siliconizing, and a method for manufacturing a high silicon electrical steel sheet using the same. The coating composition includes: a Fe—Si-based composite compound sintered powder having a grain size of −325 mesh and containing 20-70% silicon by weight; and a colloidal silica solution containing 15-30 part by weight of silica solid matter with respect to 100 part by weight of the sintered powder.

26 Claims, No Drawings

COATING COMPOSITION, AND METHOD FOR MANUFACTURING HIGH SILICON ELECTRICAL STEEL SHEET USING THEREOF

TECHNICAL FIELD

The present invention relates to a coating composition for siliconizing treatment of electrical steel sheets, and a method for manufacturing an electrical steel sheet using the same, and more specifically, to a coating composition for effectively siliconizing electrical steel sheets through a diffusion annealing process, and a method for manufacturing a high silicon electrical steel sheet having outstanding high frequency magnetic properties as well as outstanding commercial frequency properties by using the coating composition.

BACKGROUND ART

Electrical steel sheets are generally classified into grain-oriented electrical steel sheet and non-oriented electrical steel sheet. Grain-oriented electrical steel sheet contains 3% silicon (Si) and has a texture in which grains are oriented in an orientation {(110)[001]}. Superior magnetic properties in the rolling direction allow these grain-oriented electrical steel sheet products to be used as core material of transformers, motors, generators and other electronic devices. Non-oriented electrical steel sheet is characterized, by orientations of grains being irregularly arranged and magnetic deviation according to magnetization direction being small. Due to these characteristics, the non-oriented electrical steel sheet is mainly used in a core for rotating machine such as generators or motors, in which magnetic flux direction is varied.

Recently, as electrical devices are diversified, demands on devices operating in high frequency band-increase and thus desires on core material with superior magnetic properties in high frequency also start to increase.

In the meanwhile, in alloys of Fe—Si, since higher silicon contents allow hysteresis loss, magnetostriction, coercive force, and magnetic anisotropy among core loss properties to decrease and maximum permeability to increase, it is said that high silicon steel products are superior soft magnetic material. Then, the decrease of magnetostriction and the increase of maximum permeability do not continue limitlessly according to the increase of silicon content but show maximum values in 6.5% Si steel. Also, it is well known that magnetic properties of 6.5% Si steel reach the maximum state in high frequency band as well as commercial frequency band. Due to the superior magnetic properties in high frequency band, high silicon steel is mainly applicable to high frequency reactor for gas turbine generator, tank power supply, induction heating device, uninterruptible power supply, or the like, and high frequency transformer for plating power supply, welding machine, X-ray power supply or the like, and is being used as substitution material. In addition, the high silicon steel is applicable for use to reduce power consumption of a motor and improve the efficiency of the motor.

Then, since elongation of the silicon steel sheet decreases abruptly as silicon content in Fe—Si steel increases, it is known that it is nearly impossible to manufacture the silicon steel sheet containing in excess of 3.5% Si by a cold rolling. In spite of such a fact that higher Si contents are effective in obtaining superior magnetic properties, the manufacture of such a high silicon steel sheet is recognized as a limitation of the cold rolling. Accordingly, researches on a new substitution technology that can overcome the limitation of the cold rolling are being tried from a long time ago.

Among the prior art methods for the manufacture of high silicon steel sheets, Japanese Patent Laid Open Publication No. 56-3625, discloses direct casting of high silicon steel using a single roll or twin rolls, Japanese Patent Laid Open Publication No. 62-10332 discloses a warm rolling in which rolling is performed in a heated state at a proper temperature, and Japanese Patent Laid Open Publication No. 5-171281 discloses a clad rolling in which rolling is performed in a state wherein the high silicon steel is located at an inner portion and a low silicon steel is located at an outer portion. However, the aforementioned prior art has not yet been commercialized.

For mass production of high silicon steel products such as 3% Si non-oriented steel products, a well known process includes the steps of depositing silicon on a surface of a material by a chemical vapor deposition using $SiCl_4$ and then homogenizing the silicon, as disclosed in Japanese Patent Laid Open Publication No. 62-227078, U.S. Pat. No. 3,423,253, among others. However, the above process causes the manufactured products to be sold inevitably at a price five times higher than the conventional 3% Si steel products due to the difficulty in the CVD process. In spite of this fact that these products possess superior magnetic properties, it is difficult to popularize and commercialize such products due to the excessive high cost thereof.

Also, EP1052043A2, JP2000192204, JP2000144248, JP200045025, among others, disclose processes for manufacturing high silicon steel sheets using powder metallurgy. However, these prior arts have a limitation in that the high silicon content prevents the manufacture of steel sheet with the desired thickness.

Further, U.S. Pat. Nos. 3,634,148, 4,073,668 and the like propose a long-term annealing process in which Fe—Si alloy powder only or a mixed powder of Fe—Si powder and binder is prepared. The mixed powder is rolled at a reduction ratio less than 5% and then annealed for a long term. However, the process to coat powder on matrix material and then apply a rolling process makes it difficult to perform cold rolling and is also not desirable in a mass production system. Also, a low temperature long term annealing is not proper in mass production upon considering the productivity.

Among the currently circulated electrical steel products, only non-oriented electrical steel sheets containing 6.5% Si are produced and sold as the high silicon steel product. Owing to an irregular arrangement of grain, the non-oriented electrical steel sheets containing 6.5% Si content is used in the rotator with a small magnetic deviation according to magnetizing direction orientations. However, high silicon grain-oriented electrical steel sheet products, which demonstrate excellent characteristics in use for the transformer mainly using only the magnetic property in the rolling direction, have not yet been commercialized. Accordingly, various attempts to produce a grain-oriented electrical steel sheet with superior magnetic properties due to high silicon content have been performed, but it has not been informed yet on the success to produce such products.

SUMMARY OF THE INVENTION

Accordingly, the present invention has been made in an effort to solve the above-described problems of the prior arts.

An object of the invention is to provide a coating composition for effectively siliconizing electrical steel sheets through a diffusion annealing process.

Another object of the invention is to provide a method for manufacturing a high silicon electrical steel sheet having outstanding high frequency magnetic properties by coating the coating composition on a surface of the electrical steel sheet and diffusion annealing the coated steel sheet to thereby siliconize the electrical steel sheet.

To achieve the above object and other advantages and in accordance with the purpose of the invention, as embodied and broadly described herein, there is provided a coating composition including: a Fe—Si-based composite compound sintered powder having a grain size of −325 mesh and containing 20-70% silicon by weight; and a colloidal silica solution containing 15-30 part by weight of silica solid matter with respect to 100 part by weight of the sintered powder.

In an aspect of the present invention, there is provided a method for manufacturing a high silicon electrical steel sheet, comprising the steps of: coating and drying the coating composition prepared as above on a surface of a steel sheet containing 2.0-3.3 wt % Si; and diffusion-annealing the dried steel sheet in a nitrogen gas atmosphere containing 20% or more hydrogen at a temperature range of 1000-1200° C.

In another aspect of the present invention, there is provided, in a method for manufacturing a high silicon grain-oriented electrical steel sheet, comprising the steps of: reheating and hot-rolling a steel slab to produce a hot rolled steel sheet; annealing the hot rolled sheet and cold-rolling the annealed steel sheet to adjust a thickness of the steel sheet; decarburization annealing the steel sheet; and secondary recrystallization annealing the steel sheet, the improved method further comprising the step of: picking(pickling) the surface of the grain-oriented electrical steel sheet where the secondary recrystallization is completed to remove a surface oxide layer; coating and drying the coating composition as described above on the surface of the pickled electrical steel sheet; and diffusion-annealing the dried electrical steel sheet in a nitrogen gas atmosphere containing 20% or more hydrogen at a temperature range of 1000-1200° C.

In another aspect of the present invention, there is provided, in a method for manufacturing a high silicon non-oriented electrical steel sheet, comprising the steps of: reheating and hot-rolling a steel slab to produce a hot rolled steel sheet; annealing the hot rolled sheet and cold-rolling the annealed steel sheet to adjust a thickness of the steel sheet; recrystallization annealing the cold-rolled steel sheet, the improved method further comprising the step of: coating and drying the coating composition as described above on the surface of the cold rolled steel sheet; and diffusion-annealing the dried electrical steel sheet in a nitrogen gas atmosphere containing 20% or more hydrogen at a temperature range of 1000-1200° C.

DETAILED DESCRIPTION OF THE INVENTION

Hereinafter, the present invention will be described.

When contacting silicon (Si) containing metal with Fe metal under high temperature hydrogen or nitrogen atmosphere more than 950° C., there occurs an interdiffusion reaction where Si atoms diffuse into Fe metal and Fe atoms diffuse into Si containing metal to make the concentration of Fe and Si in both sides to be identical. Accordingly, when contacting Si metal powder on surfaces of the electrical steel sheet and then annealing the electrical steel sheet at a high temperature, a difference in silicon concentration causes an interdiffusion reaction where Si atoms are moved inside the steel sheet and Fe atoms of the steel sheet are moved toward the powder to be progressed.

When comparing the interdiffusion reaction of Fe atoms and Si atoms, since the diffusion rate of Si is approximately two times greater than that of Fe atoms in a temperature range of 1000-1200° C., a phenomenon occurs, known as the Kirkendall effect corresponding to a non-homogenous diffusion state. This non-homogeneous diffusion state causes non-homogeneous state defects at a reaction interface or creates various compounds such as $FeSi_2$, FeSi, $Fe_5Si_3$ or $Fe_3Si$, which act as a factor in deteriorating magnetic properties. Accordingly, it is in fact impossible to produce high silicon grain-oriented electrical steel sheets having a homogeneous composition without surface defects by coating the silicon containing powder on the electrical steel sheet and diffusing Si atoms at a high temperature.

To solve the above problem, the inventor repeated researches on diffusion principle and so forth using Si powder and Fe powder, and finally found that the defects in the diffusion reaction portion are effectively removed not by using a coating composition including Si powder only as siliconizing agent but by using a coating composition of a Fe—Si-based composite compound.

The present invention provides a coating composition for siliconizing, and a method for manufacturing an electrical steel sheet using the coating composition. The coating composition is formulated to enable a diffusion where Si atoms and Fe atoms are substituted with each other by an identical amount without forming any Fe—Si-bonded composite compound so as to avoid causing a surface defect at a diffusion reaction portion of the steel surface when the coating composition is coated on the surfaces of the electrical steel sheet and then annealed.

Unit technologies employed in the present invention to control the diffusion amount of Si atoms will be described below.

First, to further lower the diffusion rate of the Si component, powder containing only Si metal is not used but Fe—Si-based compound such as $FeSi_2$, FeSi, $Fe_5Si_3$ or $Fe_3Si$, wherein Si metal is bonded to Fe metal, is used as the main composition of the siliconizing coating agent. For this purpose, i.e., in order for the Fe—Si-based sintered powder to exist in a compound, the invention limits the Si content of the powder to 70 wt % or less.

Second, to suppress the diffusion of Si atoms, the grain size of Fe—Si-based sintered powder is made fine, and the fine Fe—Si-based sintered powder is coated on the surface of the steel sheet, thereby reducing a surface contact area between the matrix material and the metal powder, i.e., interreaction area to 30% or less compared with a plate contact. Specifically, the present invention limits the grain size of the Fe—Si-based sintered powder to −324 mesh.

Third, to secure adhesion of Fe—Si-based annealed powder prepared as above to the surface of the matrix material and to secure coatability of the annealed powder, micro fine silica particles having a size corresponding to colloidal particle and a very excellent dispersity in water are added as binder of the coating composition.

Lastly, when the Fe—Si-based sintered powder is coated in a slurry state on surfaces of steel sheet and then annealed at a high temperature, the present invention controls atmosphere gas such that thin oxide film is formed on the surfaces of the steel sheet. This surface oxide layer acts as a hindrance film of the interdiffusion reaction to suppress diffusion of Si atoms toward the matrix material.

First, the inventive coating composition for siliconizing will be described in detail.

Fe—Si-based powder, the main component of the coating composition for siliconizing of the present invention, can be manufactured by mixing Fe powder and Si powder with each other, and sintering the mixed powder at a temperature range of 1000-1200° C. in mixture gas atmosphere of hydrogen and nitrogen for 3-5 hours, but is necessarily not restricted thereto and can be manufactured by various methods. At this time, the component ratio of the sintered powder compound is changed depending on the mixed amount of Fe powder and Si powder. Theoretically, when the mixed amount is 50%Si+50%Fe, the compound $FeSi_2$ is created; when the mixed amount is 34%Si+66%Fe, the compound FeSi is created; when the mixed amount is 25%Si+75%Fe, the compound $Fe_5Si_3$ is created; and when the mixed amount is 14%Si+86%Fe, the compound $Fe_3Si$ is created. However, in actual sintering, small amounts of several compounds may exist according to an initial mixing state. In particular, when a sintering reaction is generated by a mixing of Fe powder and Si powder, the reaction progresses in such a manner that Si atoms and Fe atoms are interdiffused to invade. Hence, although the amount of Si is somewhat large, the sintered powder reaches a state in which most of $FeSi_2$ compound or FeSi compound corresponding to a state wherein Fe atoms have been diffused and are present at the surfaces of the sintered powder and pure Si atoms are present at inside of the sintered powder. Accordingly, at most of the surface of the sintered powder, an Fe—Si-based compound is present.

In the present invention, the Si content in the Fe—Si-based sintered powder obtained as above is restricted to 20-70 wt %. If the Si content is less than 20 wt %, it is so small and thus the diffusion rate may be very slow. Also, the high density of the sintered powder may cause a drop of the dispersion while the coating process is performed in practice. Since the content of Si exceeding 70 wt % allows the main component to exist as $FeSi_2$ and a mixture of extra metal Si phase, the metal Si component contacts with the surface of material to increase the possibility of creating defects on the surface during the siliconizing process so that the control of the silicon content as siliconized may be difficult. In other words, by restricting the Si content contained in the Fe—Si-based sintered powder to a range of 20-70 wt %, it is possible to manufacture Fe—Si-based composite compound sintered powder having $FeSi_2$, FeSi, $Fe_5Si_3$ or $Fe_3Si$ as a main component. It is more preferable that the content of $FeSi_2$+FeSi amount the Fe—Si-based composite compounds should be restricted to 90 wt % or more with respect to the total weight of the annealed powder.

Also, when preparing the aforementioned Fe—Si-based sintered powder in the present invention, it is preferable to form a thin oxide film on surfaces of the sintered powder during the sintering and cooling processes. The thin oxide film controls the diffusion rate of silicon during a subsequent diffusion-annealing reaction, thereby suppressing defect creation in the surface of the matrix material and allowing products having excellent magnetic properties to be obtained.

More preferably, the oxygen content in the formed surface oxide film is limited to 2.0% or less. This is because the oxygen content exceeding 2.0% causes the diffusion rate of Si to be too slow.

In the meanwhile, to improve coatability and surface shape of matrix material in the present invention, it is preferable to add ultra fine $SiO_2$ powder, alumina powder and alumina sol to the coating composition prepared as above.

More preferably, at least one selected from the group consisting of fine $SiO_2$ powder, alumina powder and alumina sol is added by 0.2-3.5 part by weight with respect to 100 part by weight of the Fe—Si-based sintered powder having the aforementioned grain size and composition. If the added amount is less than 0.2 part by weight, improvement effect followed by the addition is weak. If the added amount exceeds 3.5 part by weight, surface properties may be deteriorated due to excessive coating amount.

When Fe—Si-based sintered powder manufactured as above is used as coating agent of electrical steel sheets, this powder is made in a slurry state and then coated on a surface of the steel sheet by using a roll coater, which is most economical in production stage. The Fe—Si-based sintered powder as siliconizing agent should be made as fine as possible, which enhances the coating workability in a production stage and is advantageous in terms of management of surface shape on diffusion reaction. However, since the Fe—Si-based sintered powder where sintering reaction is completed is in a state of fused lump by a high temperature and long term reaction, it is necessary to control the grain size of the powder as fine as possible.

Accordingly, the present invention makes the grain size of Fe—Si-based sintered powder finely considering such a circumstance. Finer grain is advantageous in the coatability. Preferably, it is noted that the grain size should be restricted to −325 mesh upon considering the productivity and costs for formation of fine powder.

In the meanwhile, considering the actual coatability of the Fe—Si-based sintered powder prepared as above and the control of diffusion amount of Si as coated, the powder is dissolved in solvent to make a slurry solution, and then the prepared slurry solution is used as coating composition.

As the solvent, colloidal silica solution is used. At this time, silicon component is ultra fine $SiO_2$ particles having a colloidal size. Since these ultra fine $SiO_2$ particles are dispersed in water, when they are used mixed with other solid particles, viscosity of the slurry solution can be increased to secure the coating workability.

In the present invention, it is preferable to add silica solution composed having 15-30 part by weight of silica with respect to the solid matter, to 100 part by weight of the Fe—Si-based powder. If the added amount is less than 15 part by weight, the coating composition shows a severe surface splitting due to the tension difference between the coating composition and the surface of the matrix material crevice, so that adhesion to the surface of the matrix material may be poor. If the amount exceeds 30 part by weight, the coatability is poor and the diffusion rate of silicon is too late during a subsequent homogenizing process so that a long-term annealing is needed, which is undesirable.

Next, a manufacturing process of an electrical steel sheet using the coating composition will be described.

The present invention discloses the manufacture of high silicon electrical steel sheets by coating the aforementioned coating composition on electrical steel sheets manufactured by a conventional process and containing a predetermined content of silicon (preferably, containing 2.0-3.3 wt % silicon). In other words, the aforementioned coating composition is coated on surfaces of non-oriented electrical steel sheets as well as surfaces of grain-oriented electrical steel sheet manufactured by a conventional process, and then annealed at a high temperature to thereby manufacture high silicon electrical steel sheets.

Grain-Oriented Electrical Steel Sheet

The manufacturing processes of the grain-oriented electrical steel sheet may show somewhat differences according to the manufacturers. However, the process generally includes the steps of: adjusting components in steel making; producing a steel slab from molten steel; reheating the steel slab; hot rolling the reheated steel slab; annealing a hot rolled sheet and cold rolling an annealed steel sheet to adjust the thickness of the steel sheet; decarburization annealing the steel sheet;

performing a high temperature annealing of the steel sheet for a secondary recrystallization; and finish coating an insulating film. However, the invention is not limited to the above concrete manufacturing process and procedure. For instance, the inventive process may omit the hot rolled annealing step, or can be applied to a manufacturing process of an electrical steel sheet including the nitrizing step together with the decarburization annealing.

The products manufactured by the above process have a dual film structure consisting of a glass film (scientific name, forsterite, $2MgO.SiO_2$) and an insulating film formed during the high temperature annealing. Also, there are glassless products in which special additive is added during a high temperature annealing to form a matrix layer where the formation of the glass layer is suppressed, and form an insulating film on the matrix layer.

In the present invention, the coating composition having the aforementioned composition can be coated on surfaces of a conventional grain-oriented electrical steel sheet where the secondary recrystallization is completed and thus basic magnetic properties are obtained. In other words, the object of the present invention can include all the grain-oriented electrical steel sheet products where the secondary recrystallization is completed, such as high temperature annealing plate, glassless steel sheet products and steel sheet products on which dual films are formed.

While the grain-oriented electrical steel sheet as the starting material of the invention essentially contains Si component, and may further contain necessary metals or non-metal element, such as Mn, Al, S, N and the like as an auxiliary agent according to the manufacturing process, the additive is not limited only to the aforementioned concrete components. It is more preferably noted that the grain-oriented electrical steel sheet on which the coating composition is being coated contains 2.9-3.3% Si with respect to the weight % of the steel sheet itself.

In the present invention, the surface film formed on the steel sheet which is subject to the secondary recrystallization annealing is removed by a pickling treatment, and then the coating composition having the aforementioned composition is coated on the steel sheet by a roll coater. At this time, the coated amount of the coating composition coated on the steel sheet is preferably determined by the below formulas 1 and 2:

$$Y-5 \leqq \text{coated amount} \leqq Y+5 \quad \text{formula 1}$$

$$Y(\text{g/m}^2)=7650t(x1-x2)/(A-14.4) \quad \text{formula 2}$$

Where 't' is thickness of matrix material, A is Si content (%) in the Fe—Si-based annealed powder, x1 is a target Si content (%) of matrix material, and x2 is an initial Si content of matrix material.

Thus, the steel sheet coated with the coating composition is preferably dried at a temperature range of 200-700° C. If the drying temperature is less than 200° C., the drying time is too long so that productivity is lowered. If the drying temperature exceeds 700° C., oxide may be created on a surface of the steel sheet.

After that, the dried steel sheet is loaded in an annealing furnace and diffusion-annealed. At this time, the annealing temperature is restricted to 1000-1200° C. If the annealing temperature is less than 1000° C., siliconizing rate is too slow so that a long time is taken for the diffusion and the surface shape at the boundary of the siliconizing reaction is coarse and thus magnetic properties may be deteriorated. If the annealing temperature exceeds 1200° C., reaction rate is too fast, and surfaces of rolled coil are adhered to deteriorate the separation workability.

Accordingly, the diffusion annealing temperature is preferably restricted to 1050-1200° C. considering the surface shape at the boundary, and the workability.

Also, in the present invention, it is necessary to control the atmosphere gas in a nitrogen gas atmosphere containing 20% or more hydrogen gas during the diffusion annealing step. This is because if the hydrogen content is less than 20%, thin and dense $SiO_2$-based oxide is formed on the matrix material so that the siliconizing reaction is hindered, and if Al component exists partly, in cooling after annealing, AlN is precipitated and thereby core loss can be abruptly deteriorated.

The diffusion annealing time is preferably restricted to 1-10 hours. If the diffusion annealing time is less than 1 hour, the siliconizing amount is small, and if the diffusion annealing time exceeds 10 hours, the siliconizing amount is excessive to make difficult a proper control, and an excessive long-term reaction may deteriorate the surface shape of the matrix material.

In the meanwhile, an insulating coating layer can be again formed on the surfaces of the siliconized steel sheet.

This insulating coating layer is formed by a conventional method in which an insulating coating agent prepared by mixing a small amount of chromic acid to a mixture of phosphate of magnesium (Mg), aluminum (Al) and calcium (Ca), and colloidal silica component is coated or is formed by coating organic/inorganic composite coating agent having chromate and acryl-based resin as main components for drawability. However, the present invention is not restricted only to the aforementioned concrete composition of the insulating coating agent.

Non-Oriented Electrical Steel Sheet

The manufacturing processes of the non-oriented electrical steel sheet may show some differences according to the manufacturers, basic manufacturing process, or use. However, the process generally includes the steps of: adjusting components in steel making; producing a steel slab from the molten steel; reheating the steel slab; hot rolling the reheated steel slab; annealing a hot rolled sheet and cold rolling an annealed steel sheet to adjust the thickness of the steel sheet; recrystallization annealing the cold-rolled steel sheet; and finish coating an insulating film. Various products for non-oriented electrical steel sheet are being produced and sold depending on the manufacturing process, Si content, or level of magnetic properties.

In the present invention, the matrix material on which the aforementioned coating composition is being coated is a cold rolled steel sheet obtained by a cold rolling among the manufacturing steps of non-oriented electrical steel sheet. The cold rolled steel sheet is coated with the coating composition and then annealed at a high temperature so as to have a high silicon content. At this time, the cold rolled steel sheet preferably contains 2.0-3.3% Si with respect to the weight % of the steel sheet itself. This is because if the Si content is less than 2.0%, it takes a long time for siliconizing reaction using Fe—Si-based powder, which is a siliconizing agent, and is disadvantageous in an economical aspect in that, if the Si content exceeds 3.3%, the steel sheet is brittle so that cold rolled capability is very poor.

In the present invention, the coating composition with the aforementioned composition is coated on the surfaces of the prepared steel sheet by a roll coater.

Herein, prior to coating the coating composition, it is desirable to perform an intermediate annealing of the cold rolled sheet plate. By performing temperature elevation and uniform heat treatment of the cold rolled steel sheet in an intermediate annealing furnace where successive works are possible, texture of the matrix material is improved to thereby induce the optimization of initial magnetic properties. Also, by properly controlling the annealing atmosphere condition in the intermediate annealing, a thin and dense oxide film having faylite ($Fe_2SiO_4$) as a main component is formed during a subsequent siliconizing step, and acts as a stop layer for suppressing the formation of Fe3Si-based intermediate phase compound while Si component of Fe—Si-based sintered powder is diffused into the matrix material, so that surface shape, i.e., surface roughness, is improved and thus magnetic properties are improved compared with those as siliconized with an identical Si component.

At this time, it is desirable to restrict the intermediate-annealing temperature to 950-1100° C. If the intermediate-annealing temperature is less than 950° C., the improvement effect in the texture is deficient, and if the temperature exceeds 1100° C., it is difficult to manage the facility.

Also, the intermediate annealing is preferably performed in a nitrogen atmosphere containing 50% or more hydrogen and a moisture atmosphere where oxidization capability ($PH_2O/PH_2$) referenced by dew point is adjusted in a range of 0.06-0.30. In a hydrogen atmosphere containing less than 50%, it may be difficult to manage the oxidization capability and the control of the total oxygen content contained in the oxide. Also, if $PH_2O/PH_2$ exceeds the range of 0.06-0.30, the hydrogen atmosphere fails to form faylite.

In the present invention, it is desirable to control the total oxygen content contained in the surface oxide layer of the intermediate-annealed steel sheet to 210-420 ppm. If the total oxygen content is less than 210 ppm, a capability for suppressing the creation of $Fe_3Si$ that is an intermediate defect phase is deficient, and if the oxygen content exceeds 420 ppm, a large amount of FeO oxide film is formed on the faylite.

In the present invention, when the coating composition having the aforementioned composition is coated on surfaces of the cold rolled steel sheet or surfaces of the intermediate annealed steel sheet by a roll coater, the coated amount of the coating composition is preferably determined by the below formulas 1 and 2:

$$Y-5 \leqq \text{coated amount} \leqq Y+5 \qquad \text{formula 1}$$

$$Y(\text{g/m}^2)=7650t(x1-x2)/(A-14.4) \qquad \text{formula 2}$$

Where 't' is thickness of matrix material, A is Si content (%) in the Fe—Si-based powder, x1 is a target Si content (%) of matrix material, and x2 is an initial Si content (%) of matrix material.

Thus, the steel sheet coated with the coating composition is preferably dried at a temperature range of 200-700° C. If the drying temperature is less than 200° C., the drying time is too long so that productivity is lowered. If the drying temperature exceeds 700° C., oxide may be created on a surface of the steel sheet.

After that, the dried steel sheet is loaded in an annealing furnace and diffusion-annealed (homogenized). At this time, the annealing temperature is restricted to 1000-1200° C. If the annealing temperature is less than 1000° C., siliconizing rate is too slow so that a long time is taken for the diffusion and the surface shape at the boundary of the siliconizing reaction is coarse and thus magnetic properties may be deteriorated. If the annealing temperature exceeds 1200° C., reaction rate is too fast, and surfaces of rolled coil are adhered to deteriorate the separation workability.

Accordingly, the diffusion-annealing temperature is preferably restricted to 1050-1200° C. considering the surface shape at the boundary, and the workability.

Also, in the present invention, it is necessary to control the atmosphere gas in a nitrogen gas atmosphere containing 20% or more hydrogen gas during the diffusion-annealing step. This is because if the hydrogen content is less than 20%, thin and dense $SiO_2$-based oxide is formed on the matrix material so that the siliconizing reaction is hindered, and if Al component exists partly, in cooling after annealing, AlN is precipitated and thereby core loss can be abruptly deteriorated.

The diffusion-annealing time is preferably restricted to 1-10 hours. If the diffusion-annealing time is less than 1 hour, the siliconizing amount is small, and if the diffusion-annealing time exceeds 10 hours, the siliconizing amount is excessive to make difficult a proper control, and an excessive long-term reaction may deteriorate the surface shape of the matrix material.

After that, an insulating coating layer is formed on the surfaces of the siliconized steel sheet to thereby produce a final non-oriented electrical steel sheet product. In other words, non-reacted substances remaining on the surfaces of the siliconized steel sheet are removed and finally organic/inorganic composite coating agent having chromate and acryl-based resin as main components is coated, thereby producing a final high silicon non-oriented electrical steel sheet product. However, the present invention is not limited to the concrete composition of the insulating coating agent.

In the meanwhile, in the present invention, the coating composition, composed as above can be naturally applied to the final non-oriented electrical steel sheet product as well as the aforementioned cold rolled steel sheet under the aforementioned condition. However, if the coating composition is applied to the final products, a separate annealing process is required. Hence, in an aspect of omitting a manufacturing step, it is more preferable to use the cold rolled steel sheet as the matrix steel sheet on which the coating composition is being coated.

Hereinafter, the present invention will be described in more detail with respect to several presently preferred embodiments. It is understood that the below described embodiments should not be understood so as to restrict the scope of the present invention.

Embodiment 1

Through a conventional manufacturing process of grain-oriented electrical steel sheet, there were prepared grain-oriented electrical steel sheet products each having a thickness of 0.23 mm and containing Si: 3.05% by weight, Mn: 0.12% by weight, Cu: 0.025% by weight, Cr: 0.13% by weight, P: 0.013% by weight, remnant Fe and inevitably contained impurity. After an insulating layer formed on the surfaces of the steel sheets prepared as above was removed, the steel sheets were coated with slurry solution formed by dispersing Fe—Si-based sintered powders having different grain sizes and compositions as shown in table 1 in colloidal silica solution.

In the meanwhile, the used solvent colloidal silica solution is a 30% colloidal silica solution product sold in public. At this time, 20 part by weight of colloidal silica solution as referenced by the solid matter was mixed to 100 part by weight of Fe—Si-based powder.

The steel sheets coated with the Fe—Si-based powder were dried at a temperature of 400° C., and after the coated state was visually observed, rolled in a large sized coil. The rolled steel sheets were homogenized at 1125° C. in a nitrogen atmosphere containing 50% hydrogen for 4 hours. Afterwards, non-reacted substances remaining on the steel sheet where the siliconizing reaction was completed were removed and surface states were observed. Thereafter, an insulation coating agent where a small amount of chromic acid was added to a mixture of phosphate of magnesium (Mg), aluminum (Al) and calcium (Ca), and colloidal silica component, was coated on the steel sheets to form an insulation coating film, thereby manufacturing grain-oriented electrical steel sheets on which the insulating coating layer is formed.

In the products manufactured as above, Si content and magnetic properties were examined. The magnetic properties, i.e., core loss and magnetic flux density (B8) were examined by a single sheet measuring device, and are shown in the below table 1. Herein, $W_{10/50}$ represents the core loss at a frequency of 50 Hz and magnetic induction of 1.0 Tesla, $W_{10/400}$ represents the core loss at a frequency of 400 Hz, 1.0 Tesla, and $W_{5/1000}$ represents the core loss at a frequency of 1000 Hz, 0.5 Tesla, respectively. The magnetic flux density B8 represents magnetic flux per unit area, which is generated when being subject to a magnetizing force of 800A-turn/m, and matrix Si content is result values of wet analysis.

TABLE 1

| | Fe—Si Powder | | | Magnetic properties | | | | | Matrix |
|---|---|---|---|---|---|---|---|---|---|
| No. | Si (%) | Grain size (mesh) | Coated state | $B_8$ (Tesla) | $W_{10/50}$ (W/Kg) | $W_{10/400}$ (W/Kg) | $W_{5/1000}$ (W/Kg) | Surface state | Si (%) |
| 1 | 12 | −325 | Good | 1.88 | 0.32 | 7.3 | 8.7 | Good | 3.7 |
| 2 | 25 | −325 | Good | 1.79 | 0.30 | 6.7 | 7.4 | Good | 4.3 |
| 3 | 45 | −325 | Good | 1.71 | 0.27 | 6.0 | 6.7 | Good | 5.8 |
| 4 | 62.5 | −325 | Good | 1.69 | 0.26 | 5.8 | 6.4 | Good | 6.2 |
| 5 | 75 | −325 | Good | 1.57 | 0.35 | 7.9 | 8.6 | Small Hole | 7.4 |
| 6 | 85 | −325 | Good | 1.55 | 0.36 | 8.2 | 9.4 | Hole | 7.9 |
| 7 | 100 | −325 | Good | 1.52 | 0.38 | 8.8 | 10.9 | Hole | 8.5 |
| 8 | 50 | −150~+150 | Thin | 1.73 | 0.32 | 7.1 | 7.9 | Defect | 4.9 |
| 9 | 50 | −250~+250 | Non-uniform | 1.71 | 0.32 | 6.9 | 7.5 | Defect | 5.2 |
| 10 | 50 | −325 | Good | 1.70 | 0.27 | 6.1 | 6.4 | Good | 5.9 |
| 11 | 50 | −450 | Good | 1.70 | 0.26 | 6.0 | 6.4 | Good | 6.0 |

As seen from table 1, the electrical steel sheets 2 to 4, 10 and 11 controlled to have a proper silicon content in the Fe—Si-based sintered powder were increased in silicon content and thus showed superior core loss properties in high frequency band as well as in commercial frequency band. Also, they showed superior coating states.

On the contrary, the electrical steel sheet 1 having a small silicon content in the Fe—Si-based sintered powder was too small in silicon content as siliconized so that improvement effect in magnetic properties was poor. In the case of the electrical steel sheets 5 to 7 containing 70% or more Si, silicon content was large but defects such as holes were generated so that magnetic properties of the steel sheet were weakened.

In case of the electrical steel sheets 8 and 9, which are outside the grain size range of the invention, as coated in slurry state, they were thin and non-uniform in thickness, so that silicon content in the steel sheets was small and many defects were observed on the surfaces of the steel sheets, which represents a relatively low quality that the improvement in the magnetic properties was very small and the magnetic properties were deteriorated.

Embodiment 2

Steel slabs each containing Si: 2.9% by weight, Mn: 0.022% by weight, Al: 0.3% by weight, Sn: 0.025% by weight, P: 0.003% by weight, C: 0.0025% by weight, S: 0.0011% by weight, N: 0.0003% by weight, remnant Fe and inevitably contained impurity were reheated at a temperature of 1220° C., and then hot-rolled to produce hot rolled steel sheets. The hot rolled steel sheets were annealed for five minutes at 1000° C. and pickled. After the hot rolled steel sheets were cold rolled so as to have a final thickness of 0.20 mm, rolling oil coated on the surface thereof was removed.

The steel sheets were coated with slurry solution formed by dispersing Fe—Si-based sintered powders composed as shown in table 2 in colloidal silica solution. The used colloidal silica solution herein is a 30% colloidal silica solution product sold in public. At this time, 20 part by weight of colloidal silica solution as referenced by the solid matter was mixed to 100 part by weight of Fe—Si-based powder.

The steel sheets coated with the Fe—Si-based powder were dried at a temperature of 400° C., and the coated state was visually observed. After that, the dried steel sheets were rolled in a large sized coil. The rolled steel sheets were diffusion annealed at 1125° C. in a nitrogen atmosphere containing 50% hydrogen for 4 hours. Afterwards, non-reacted substances remaining on the steel sheet where the siliconizing reaction was completed were removed and surface states were observed. Thereafter, organic/inorganic composite coating agent having chromate and acryl-based resin as main components was coated to thereby manufacture non-oriented electrical steel sheets on which the insulating coating layer is formed.

In the products manufactured as above, Si content and magnetic properties were examined, and shown in the below table 2. The evaluation standards of the concrete properties are the same as those of embodiment 1.

TABLE 2

| No. | Fe—Si Powder Si (%) | Grain size (mesh) | Coated state | Magnetic properties $B_8$ (Tesla) | $W_{10/50}$ (W/Kg) | $W_{10/400}$ (W/Kg) | $W_{5/1000}$ (W/Kg) | Surface state | matrix Si (%) |
|---|---|---|---|---|---|---|---|---|---|
| 1 | 12 | −325 | Good | 1.46 | 0.80 | 11.45 | 11.06 | Good | 3.5 |
| 2 | 25 | −325 | Good | 1.38 | 0.72 | 10.24 | 10.01 | Good | 4.2 |
| 3 | 50 | −325 | Good | 1.32 | 0.64 | 9.14 | 8.98 | Good | 5.6 |
| 4 | 62.5 | −325 | Good | 1.28 | 0.62 | 8.52 | 8.43 | Good | 6.0 |
| 5 | 75 | −325 | Good | 1.23 | 0.71 | 11.02 | 11.23 | 작은 Hole | 6.8 |
| 6 | 85 | −325 | Good | 1.21 | 0.73 | 11.11 | 11.52 | Hole | 7.1 |
| 7 | 100 | −325 | Good | 1.20 | 0.74 | 11.36 | 12.02 | Hole | 7.7 |
| 8 | 50 | −150~+250 | Thin | 1.36 | 0.70 | 10.12 | 9.96 | Defect | 4.5 |
| 9 | 50 | −250~+325 | Non-uniform | 1.35 | 0.68 | 9.88 | 9.75 | Defect | 4.8 |
| 10 | 50 | −325 | Good | 1.31 | 0.64 | 9.03 | 8.82 | Good | 5.7 |
| 11 | 50 | −450 | Good | 1.26 | 0.61 | 8.50 | 8.41 | Good | 6.1 |

As seen from table 2, the electrical steel sheets 2 to 4, 10 and 11 controlled to have an optimum grain size and composition in the Fe—Si-based sintered powder were increased in silicon content and thus showed superior core loss properties in high frequency band as well as in commercial frequency band. Also, they showed good coating states.

On the contrary, the electrical steel sheet 1 having a very small silicon content was too small in silicon content as siliconized so that improvement effect in magnetic properties was poor. In the case of the electrical steel sheets 5 to 7 containing 70% or more Si, silicon content was large but defects such as holes were generated so that magnetic properties of the steel sheet were weakened.

In the meanwhile, in case of the electrical steel sheets 8 and 9, which are outside the grain size range of the invention, they were thin and non-uniform in thickness, so that silicon content in the steel sheets was small and many defects were observed on the surfaces of the steel sheets, which represents a relatively low quality that the improvement in the magnetic properties was very small and the magnetic properties were deteriorated.

Embodiment 3

From steel slabs each containing C: 0.0020% by weight, Si: 3.15% by weight, Mn: 0.014% by weight, P: 0.025% by weight, N: 0.0002% by weight, S: 0.0003% by weight, remnant Fe and inevitably contained impurity, grain-oriented electrical steel sheet products having a thickness of 0.23 mm were manufactured by using AlN component as main inhibitor. After that, the surfaces of the steel sheets were treated in acid solution to completely remove the surface insulating layer.

After that, the steel sheets were coated with coating composition for siliconizing formed in a slurry state by dispersing Fe—Si-based sintered powders composed as shown in table 3 in colloidal silica solution.

In the meanwhile, the Fe—Si-based sintered powder used herein was manufactured by mixing Si powder and Fe powder with varying the mixing ratio in a range of 9-75% and sintering the mixture powder at a temperature of 1100-1175° C. for five hours, and then being made in a grain size less than 325 mesh. Also, the colloidal silica solution used herein is a 30% colloidal silica solution product sold in public, and silica solid matter was controlled in a range shown in table 3 and then used.

The steel sheets coated with the coating composition were dried at a temperature of 400° C., and the coated state was visually observed. After that, the dried steel sheets were coiled in a large sized coil. The coiled steel sheets were diffusion annealed at 1125° C. in a nitrogen atmosphere containing 50% hydrogen for 4 hours. Afterwards, non-reacted substances remaining on the steel sheet where the siliconizing reaction was completed were removed and then an insulation coating agent where a small amount of chromic acid was added to a mixture of phosphate of magnesium (Mg), aluminum (Al) and calcium (Ca), and colloidal silica component, was coated on the steel sheets to form an insulation coating film, thereby manufacturing final high silicon grain-oriented electrical steel sheets on which the insulating coating layer is formed.

In the products manufactured as above, Si content and magnetic properties were examined, and shown in the below table 3. The evaluation standards of the concrete properties are the same as those of embodiment 1.

TABLE 3

| No. | Fe—Si powder Si Content (%) | Added Amount (g) | c.$SiO_2$ added amount (g) | Coated state | Magnetic properties $B_8$ (Tesla) | $W_{10/50}$ (W/Kg) | $W_{10/400}$ (W/Kg) | $W_{5/1000}$ (W/Kg) | Matrix Si content (%) |
|---|---|---|---|---|---|---|---|---|---|
| 1 | | | — | | 1.92 | 0.31 | 7.6 | 9.2 | 3.1 |
| 2 | 9 | 100 | 25 | Thin | 1.90 | 0.31 | 7.4 | 9.1 | 3.4 |
| 3 | 20 | 100 | 25 | Good | 1.85 | 0.28 | 6.8 | 7.5 | 4.0 |

TABLE 3-continued

| No. | Fe—Si powder Si Content (%) | Fe—Si powder Added Amount (g) | c.$SiO_2$ added amount (g) | Coated state | Magnetic properties $B_8$ (Tesla) | $W_{10/50}$ (W/Kg) | $W_{10/400}$ (W/Kg) | $W_{5/1000}$ (W/Kg) | Matrix Si content (%) |
|---|---|---|---|---|---|---|---|---|---|
| 4 | 50 | 100 | 25 | Good | 1.69 | 0.25 | 5.6 | 6.2 | 6.3 |
| 5 | 75 | 100 | 25 | Thick | 1.54 | 0.36 | 8.4 | 10.7 | 7.5 |
| 6 | 40 | 100 | 10 | Delamination | 1.48 | 0.33 | 7.9 | 9.9 | 6.9 |
| 7 | 40 | 100 | 25 | Good | 1.71 | 0.26 | 5.8 | 6.3 | 5.8 |
| 8 | 40 | 100 | 40 | Thin | 1.87 | 0.29 | 7.3 | 8.8 | 3.5 |

As seen from table 3, compared with the electrical steel sheet 1 corresponding to the conventional material, the electrical steel sheets 3, 4 and 7 controlled to have a proper composition in the Fe—Si-based powder were greatly increased in silicon content and thus showed superior core loss properties in high frequency band of 400 Hz and 1000 Hz as well as in commercial frequency band.

On the contrary, the electrical steel sheet 2 having a very small silicon content was too small in coating amount and silicon content as siliconized so that improvement effect in magnetic properties was poor. In case of the electrical steel sheet 5 containing too much Si, silicon content was large but surface state is coarse so that core loss characteristics were rather deteriorated.

Also, in case of the electrical steel sheet 6 having a relatively small silica content, delamination of the coated film was severe and core loss characteristics were rather deteriorated. In case of the electrical steel sheet 8, the added amount of the colloidal silica was too much, the coated amount of the coating composition was small and silicon content as siliconized was small so that the improvement effect in the magnetic properties was small.

Embodiment 4

Steel slabs each containing C: 0.0015% by weight, Si: 2.95% by weight, Mn: 0.022% by weight, P: 0.003% by weight, Ni: 0.012% by weight, N: 0.0006% by weight, S: 0.0011% by weight, remnant Fe and inevitably contained impurity were reheated at a temperature of 1220° C., and then hot-rolled annealed to produce hot rolled steel sheets having a thickness of 2.5 mm. The hot rolled steel sheets were annealed for five minutes at 1000° C. and pickled. After the hot rolled steel sheets were cold rolled so as to have a final thickness of 0.20 mm, rolling oil coated on the surface thereof was removed.

First, one of the cold rolled steel sheets obtained as above was recrystallization-annealed at 1020° C. in a nitrogen atmosphere containing 25% hydrogen for 2 minutes like the conventional manufacturing process of non-oriented electrical steel sheet. For comparison with the conventional steel sheets, coating composition was coated as shown in table 4 on the surfaces of the plurality of cold rolled steel sheets obtained as above.

In the meanwhile, the Fe—Si-based powder used herein was manufactured by mixing Si powder and Fe powder with varying the mixing ratio in a range of 10-80% and sintering the mixture powder at a temperature of 1100-1175° C. for five hours, and then being made in a grain size less than 325 mesh. Also, the colloidal silica solution used herein is a 30% colloidal silica solution product sold in public, and silica solid matter was controlled in a range shown in table 4 and then used.

The steel sheets coated with the coating composition were dried at a temperature of 400° C., and the coated state of the surfaces was visually observed. After that, the dried steel sheets were coiled in a large sized coil. The coiled steel sheets were homogenized at 1150° C. in a nitrogen atmosphere containing 75% hydrogen for 5 hours. Afterwards, non-reacted substances remaining on the steel sheet where the siliconizing reaction was completed were removed and surface states were observed. Thereafter, organic/inorganic composite coating agent having chromate and acryl-based resin as main components was coated to thereby manufacture non-oriented electrical steel sheets on which the insulating coating layer is formed.

In the products manufactured as above, Si content and magnetic properties were examined, and shown in the below table 4. The evaluation standards of the concrete properties are the same as those of embodiment 1.

TABLE 4

| No. | Fe—Si powder Si Content (%) | Fe—Si powder Added amount (g) | c.$SiO_2$ Added amount (g) | Coated state | Magnetic properties $B_8$ (Tesla) | $W_{10/50}$ (W/Kg) | $W_{10/400}$ (W/Kg) | $W_{5/1000}$ (W/Kg) | matrix Si content (%) |
|---|---|---|---|---|---|---|---|---|---|
| 1 | | | — | | 1.46 | 0.85 | 11.95 | 11.61 | 2.9 |
| 2 | 10 | 100 | 20 | Thin | 1.49 | 0.85 | 11.72 | 11.53 | 3.0 |
| 3 | 25 | 100 | 20 | Good | 1.38 | 0.71 | 10.05 | 9.78 | 4.3 |
| 4 | 55 | 100 | 20 | Good | 1.27 | 0.59 | 8.47 | 8.26 | 6.4 |

TABLE 4-continued

| No. | Fe—Si powder Si Content (%) | Fe—Si powder Added amount (g) | c.$SiO_2$ Added amount (g) | Coated state | Magnetic properties $B_8$ (Tesla) | $W_{10/50}$ (W/Kg) | $W_{10/400}$ (W/Kg) | $W_{5/1000}$ (W/Kg) | matrix Si content (%) |
|---|---|---|---|---|---|---|---|---|---|
| 5 | 80 | 100 | 20 | Thick | 1.23 | 0.73 | 12.03 | 12.35 | 7.1 |
| 6 | 40 | 100 | 10 | Delamination | 1.24 | 0.72 | 11.89 | 12.03 | 6.9 |
| 7 | 40 | 100 | 25 | Good | 1.33 | 0.64 | 9.24 | 8.96 | 5.5 |
| 8 | 40 | 100 | 40 | Thin | 1.45 | 0.82 | 11.35 | 11.22 | 3.4 |

As seen from table 4, compared with the electrical steel sheet 1 corresponding to the conventional material, the electrical steel sheets 3, 4 and 7 controlled to have a proper composition in the Fe—Si-based powder were greatly increased in silicon content and thus showed superior core loss properties in high frequency band of 400 Hz and 1000 Hz as well as in commercial frequency band.

On the contrary, the electrical steel sheet 2 having a very small silicon content was too small in coating amount and silicon content as siliconized so that improvement effect in magnetic properties was poor. In case of the electrical steel sheet 5 containing too much Si, silicon content was large but surface state is coarse so that core loss characteristics were rather deteriorated.

Also, in case of the electrical steel sheet 6 having a relatively small silica content, delamination of the coated film was severe and core loss characteristics were rather deteriorated. In case of the electrical steel sheet 8, the added amount of the colloidal silica was too much, the coated amount of the coating composition was small and silicon content as siliconized is small so that the improvement effect in the magnetic properties was small.

Embodiment 5

The grain-oriented electrical steel sheets described in the embodiment 3 were prepared as matrix material. Also, coating composition for siliconizing was prepared by mixing colloidal silica solution to 100 part by weight of Fe—Si-based fine powder containing 50% Si, the colloidal silica solution being composed such that silica has 25 part by weight with respect to the weight of the solid matter. The prepared coating composition was coated on the surfaces of the matrix steel sheets by using a roll coater. The coated steel sheets were dried at a temperature of 400° C., and were coiled in a large sized coil.

The coiled steel sheets were homogenized with varying the annealing condition as shown in table 5 to thereby remove non-reacted substances remaining on the surfaces of the steel sheets. Then, an insulation coating agent where a small amount of chromic acid was added to a mixture of phosphate of magnesium (Mg), aluminum (Al) and calcium (Ca), and colloidal silica component, was coated on the steel sheets to form an insulation coating film, thereby manufacturing final high silicon grain-oriented electrical steel sheets on which the insulating coating layer is formed.

In the products manufactured as above, Si content and magnetic properties were examined. The evaluation standards of the concrete properties are the same as those of embodiment 1.

TABLE 5

| No. | Diffusion annealing conditions Hydrogen ratio (%) | Temp. (° C.) | Magnetic properties $B_8$ (Tesla) | $W_{10/50}$ (W/Kg) | $W_{10/400}$ (W/Kg) | $W_{5/1000}$ (W/Kg) | Matrix Si content (%) |
|---|---|---|---|---|---|---|---|
| 1 | 0 | 1125 | 1.89 | 0.30 | 7.5 | 9.3 | 3.3 |
| 2 | 10 | 1125 | 1.84 | 0.29 | 7.3 | 8.8 | 3.6 |
| 3 | 25 | 1125 | 1.73 | 0.26 | 6.0 | 6.3 | 5.4 |
| 4 | 90 | 1125 | 1.72 | 0.25 | 5.8 | 6.2 | 5.7 |
| 5 | 50 | 950 | 1.92 | 0.34 | 7.9 | 9.6 | 3.1 |
| 6 | 50 | 1100 | 1.74 | 0.27 | 5.9 | 6.2 | 5.4 |
| 7 | 50 | 1225 | 1.56 | 0.36 | 6.8 | 7.3 | 6.1 |
| 8 | 75 | 1125 | 1.70 | 0.24 | 5.7 | 6.3 | 5.9 |

As seen from table 5, the electrical steel sheets 3, 4, 6 and 8 controlled to have a proper homogenizing condition were increased in silicon content of matrix and thus showed superior core loss properties in high frequency band as well as in commercial frequency band.

On the contrary, the electrical steel sheets 1 and 2 which were homogenized in 100% nitrogen gas atmosphere and in a nitrogen gas atmosphere containing 10% hydrogen had a poor increase in Si content of matrix material so that improvement in core loss characteristics was deficient.

Also, in case of the electrical steel sheet 5 having a too low annealing temperature, there was nearly no variation in Si content in the matrix material so that high silicon electrical steel sheets were not obtained. In case of the electrical steel sheet 7 annealed at a high temperature of 1225° C., surface defect was generated so that core loss characteristics in commercial frequency were deteriorated.

Embodiment 6

The grain-oriented electrical steel sheets described in the embodiment 4 were prepared as matrix material. Also, coating composition for siliconizing was prepared by mixing colloidal silica solution to 100 part by weight of Fe—Si-based fine powder containing 50% Si, the colloidal silica solution being composed such that silica has 25 part by weight with respect to the weight of the solid matter. The prepared coating composition was coated on the surfaces of the matrix steel sheets by using a roll coater. The coated steel sheets were dried at a temperature of 400° C., and were coiled in a large sized coil.

The coiled steel sheets were diffusion annealed with varying the annealing condition as shown in table 6 to thereby remove non-reacted substances remaining on the surfaces of the steel sheets. Then, organic/inorganic composite coating agent having chromate and acryl-based resin as main components was coated to thereby manufacture final non-oriented electrical steel sheets on which the insulating coating layer was formed.

In the products manufactured as above, Si content and magnetic properties were examined. The evaluation standards of the concrete properties are the same as those of embodiment 1.

TABLE 6

| | Diffusion annealing conditions | | | | | | |
|---|---|---|---|---|---|---|---|
| | Hydrogen | | Magnetic properties | | | | Matrix Si |
| No. | ratio (%) | Temp. (° C.) | $B_8$ (Tesla) | $W_{10/50}$ (W/Kg) | $W_{10/400}$ (W/Kg) | $W_{5/1000}$ (W/Kg) | content (%) |
| 1 | 0 | 1150 | 1.49 | 0.84 | 11.68 | 11.48 | 3.0 |
| 2 | 10 | 1150 | 1.46 | 0.81 | 10.98 | 10.88 | 3.4 |
| 3 | 25 | 1150 | 1.35 | 0.68 | 9.48 | 9.13 | 5.0 |
| 4 | 90 | 1150 | 1.34 | 0.67 | 9.41 | 9.07 | 5.3 |
| 5 | 50 | 950 | 1.48 | 0.85 | 11.70 | 11.34 | 3.0 |
| 6 | 50 | 1100 | 1.35 | 0.71 | 9.55 | 9.31 | 4.9 |
| 7 | 50 | 1225 | 1.23 | 0.86 | 11.34 | 11.01 | 5.8 |
| 8 | 75 | 1150 | 1.33 | 0.63 | 9.18 | 8.88 | 5.7 |

As seen from table 6, the electrical steel sheets 3, 4, 6 and 8 controlled to have a proper diffusion annealing condition were increased in silicon content of matrix and thus showed superior core loss properties in high frequency band as well as in commercial frequency band.

On the contrary, the electrical steel sheet 1 which was diffusion annealed in 100% nitrogen gas atmosphere and in a nitrogen gas atmosphere containing 10% hydrogen had a poor increase in Si content of matrix material so that improvement in core loss characteristics was deficient.

Also, in case of the electrical steel sheet 2 having a too low annealing temperature of 950° C., there was nearly no variation in Si content in the matrix material so that high silicon electrical steel sheets were not obtained. In case of the electrical steel sheet 7 annealed at a high temperature of 1225° C., surface defect was generated so that core loss characteristics in commercial frequency were deteriorated.

Embodiment 7

Steel slabs each containing C: 0.0018% by weight, Si: 3.02% by weight, Mn: 0.020% by weight, P: 0.003% by weight, Ni: 0.010% by weight, N: 0.0005% by weight, S: 0.0010% by weight, remnant Fe and inevitably contained impurity were reheated at a temperature of 1220° C., and then hot-rolled to produce hot rolled steel sheets having a thickness of 2.5 mm. The hot rolled steel sheets were annealed for five minutes at 1000° C. and pickled. After the hot rolled steel sheets were cold rolled so as to have a final thickness of 0.20 mm, rolling oil coated on the surface thereof was removed.

The cold rolled steel sheets produced as above were intermediate-annealed under conditions shown in table 7. The intermediate-annealed steel sheets were coated with coating composition formed in a slurry state by mixing colloidal silica solution to 100 part by weight of Fe—Si-based sintered-powder containing 45 wt % Si, the colloidal silica solution being composed such that the solid matter of silica has 25 part by weight with respect to 100 part by weight of Fe—Si-based sintered powder. The coated steel sheets were dried at a temperature of 400° C., and were coiled in a large sized coil. After that, the dried steel sheets were homogenized at 1125° C. in a nitrogen atmosphere containing 50% hydrogen for 5 hours. Afterwards, non-reacted substances remaining on the steel sheet where the siliconizing reaction was completed were removed. Thereafter, organic/inorganic composite coating agent having chromate and acryl-based resin as main components was coated to thereby manufacture final high silicon non-oriented electrical steel sheets on which the insulating coating layer was formed. In the products manufactured as above, Si content and magnetic properties were examined. The evaluation standards of the concrete properties are the same as those of embodiment 1. Only, it is noted that matrix Si content is result values of wet analysis.

TABLE 7

| | Intermediate annealing condition | | | | | | | Matrix |
|---|---|---|---|---|---|---|---|---|
| | | | | Oxygen | Magnetic properties | | | Si |
| No. | Temp. (° C.) | $H_2$ (%) | $PH_2O/PH_2$ | content (ppm) | $B_8$ (Tesla) | $W_{10/50}$ (W/Kg) | $W_{5/1000}$ (W/Kg) | content (%) |
| 1 | 1050 | 75 | 0.09 | 240 | 1.27 | 0.57 | 8.22 | 6.3 |
| 2 | 1050 | 75 | 0.28 | 380 | 1.27 | 0.59 | 8.24 | 6.3 |
| 3 | 1075 | 75 | 0.25 | 350 | 1.27 | 0.58 | 8.22 | 6.2 |
| 4 | 1000 | 75 | 0.25 | 350 | 1.26 | 0.58 | 8.24 | 6.3 |
| 5 | 1050 | 50 | 0.25 | 380 | 1.27 | 0.58 | 8.21 | 6.3 |
| 6 | 1050 | 90 | 0.25 | 375 | 1.27 | 0.57 | 8.20 | 6.4 |

As seen from table 7, cold-rolled steel sheets were intermediate-annealed, coated with coating composition, and then annealed at a high temperature so that non-oriented electrical steel sheets were manufactured.

Although the present invention has been shown and described with reference to the above preferred embodiment, it is not to be understood that the invention is limited thereto. Rather, it will be apparent to those skilled in the art that various modifications and changes may be made therein without departing from the spirit and scope of the invention as defined by the appended claims.

INDUSTRIAL APPLICABILITY

As described above, the present invention uses Fe—Si-based sintered powder with an optimally adjusted composition as well as grain size, as a coating agent for siliconizing, so that the finished electrical steel sheets have a high silicon content. Accordingly, it is possible to effectively manufacture a high silicon electrical steel sheet having superior magnetic properties in commercial frequency and high frequency bands.

The invention claimed is:

1. A coating composition for siliconizing, comprising:

a Fe—Si-based composite compound sintered powder having a grain size of −325 mesh and containing 20-70% silicon by weight; and a colloidal silica solution containing 15-30 part by weight of silica solid matter with respect to 100 part by weight of the sintered powder.

2. The coating composition according to claim 1, wherein the Fe—Si-based composite compound sintered powder has a surface oxide layer formed on a surface thereof and containing oxygen less than 2.0%.

3. The coating composition according to claim 1, further comprising at least one selected from the group consisting of fine $SiO_2$ powder, alumina powder and alumina sol by 0.2-3.5 part by weight with respect to 100 part by weight of the Fe—Si-based composite compound sintered powder.

4. The coating composition according to claim 1, wherein the Fe—Si-based composite compound sintered powder substantially comprises $FeSi_2$, FeSi, $Fe_5Si_3$ or $Fe_3Si$, and comprises the sintered powder of $FeSi_2$+FeSi in excess of 90 wt % with respect to the weight of the Fe—Si-based sintered powder.

5. A method for manufacturing a high silicon electrical steel sheet, comprising the steps of:

providing a coating composition comprising a Fe—Si based composite compound sintered powder having a grain size of −325 mesh and containing 20-70% silicon by weight;

a colloidal silica solution containing 15-30 part by weight of silica solid matter with respect to 100 part by weight of the sintered powder;

coating and drying the coating composition on a surface of a steel sheet containing 2.0-3.3 wt % Si; and diffusion annealing the dried steel sheet in a nitrogen gas atmosphere containing 20% or more hydrogen at a temperature range of 1000-1200° C.

6. The method according to claim 5, wherein the drying step is performed at a temperature of 200-700° C.

7. The method according to claim 5, wherein the diffusion annealing step is performed at a temperature of 1050-1200° C.

8. In a method for manufacturing a high silicon grain-oriented electrical steel sheet, comprising the steps of: reheating and hot-rolling a steel slab to produce a hot rolled steel sheet; annealing a hot rolled sheet and cold rolling the steel sheet to adjust a thickness of the steel sheet; decarburization annealing the steel sheet; and secondary recrystallization annealing the steel sheet, the improved method further comprising the step of:

pickling the surface of the grain-oriented electrical steel sheet where the secondary recrystallization is completed to remove a surface oxide layer;

providing a coating composition comprising a Fe—Si based composite compound sintered powder having a grain size of −325 mesh and containing 20-70% silicon by weight;

a colloidal silica solution containing 15-30 part by weight of silica solid matter with respect to 100 part by weight of the sintered powder;

coating and drying the coating composition on the surface of the pickled electrical steel sheet; and diffusion annealing the dried electrical steel sheet in a nitrogen gas atmosphere containing 20% or more hydrogen at a temperature range of 1000-1200° C.

9. The method according to claim 8, wherein the steel sheet to be coated with the coating composition contains 2.9-3.3 wt % Si with respect to the weight of the steel sheet.

10. The method according to claim 8, wherein the steel sheet coated with the coating composition is dried at a temperature of 200-700° C.

11. The method according to claim 8, wherein the steel sheet coated with the coating is diffusion annealed at a temperature of 1050-1200° C.

12. The method according to claim 8, wherein the coating composition is coated on the surface of the steel sheet so as to satisfy the following formulas 1 and 2:

$$Y-5 \leqq \text{coated amount} \leqq Y+5 \quad \text{formula 1, and}$$

$$Y(\text{g/m}^2)=7650t\,(x1-x2)/(A-14.4) \quad \text{formula 2,}$$

Where 't' is a thickness of matrix material, A is a Si content (%) in the Fe—Si-based sintered powder, x1 is a target Si content (%) of matrix material, and x2 is an initial Si content of matrix material.

13. In a method for manufacturing high silicon non-oriented electrical steel sheet, comprising the steps of: reheating and hot-rolling a steel slab to produce a hot-rolled steel sheet; annealing the hot-rolled steel sheet and cold rolling an annealed steel sheet to adjust a thickness of the steel sheet; recrystallization annealing the cold-rolled steel sheet, the improved method further comprising the step of:

providing a coating composition comprising a Fe—Si based composite compound sintered powder having a grain size of −325 mesh and containing 20-70% silicon by weight;

a colloidal silica solution containing 15-30 part by weight of silica solid matter with respect to 100 part by weight of the sintered powder;

coating and drying the coating composition on the surface of the cold rolled steel sheet; and diffusion annealing the dried electrical steel sheet in a nitrogen gas atmosphere containing 20% or more hydrogen at a temperature range of 1000-1200° C.

14. The method according to claim 13, wherein the steel sheet to be coated with the coating composition contains 2.9-3.3 wt % Si.

15. The method according to claim 13, wherein the steel sheet coated with the coating composition is dried at a temperature of 200-700° C.

16. The method according to claim 13, wherein the steel sheet coated with the coating composition is homogenized at a temperature of 1050-1200° C.

17. The method according to claim 13, wherein prior to coating the coating composition, the cold rolled steel sheet is intermediate-annealed such that a total oxygen content in a surface oxide layer of the steel sheet is 210-420 ppm.

18. The method according to claim 17, wherein the cold rolled steel sheet is intermediate-annealed at a temperature range of 950-1100° C.

19. The method according to claim 17, wherein the cold rolled steel sheet is intermediate-annealed in a nitrogen atmosphere containing 50% or more hydrogen and a moisture atmosphere with a dew point ($PH_2O/PH_2$): 0.06-0.30.

20. The method according to claim 13, wherein the coating composition is coated on the surface f the steel sheet so as to satisfy the following formulas 1 and 2:

$$Y-5 \leqq \text{coated amount} \leqq Y+5 \quad \text{formula 1, and}$$

$$Y(\text{g/m}^2)=7650t(x1-x2)/(A-14.4) \quad \text{formula 2,}$$

where 't' is a thickness of matrix material A is a Si content (%) in the Fe—Si-based sintered powder, x1 is a target Si content (%) of matrix material, and x2 is an initial Si content of matrix material.

21. The method of claim 8, wherein the Fe—Si-based composite compound sintered powder has a surface oxide layer formed on a surface thereof and containing oxygen less than 2.0%.

22. The method of claim 8, further comprising at least one selected from the group consisting of fine $SiO_2$ powder, alumina powder and alumina sol by 0.2-3.5 part by weight with respect to 100 part by weight of the Fe—Si-based composite compound sintered powder.

23. The method of claim 8, wherein the Fe—Si-based composite compound sintered powder substantially comprises $FeSi_2$, FeSi, $Fe_5Si_3$ or $Fe_3Si$, and comprises the sintered powder of $FeSi_2$+FeSi in excess of 90 wt % with respect to the weight of the Fe—Si-based sintered powder.

24. The method of claim 13, wherein the Fe—Si-based composition compound sintered powder has a surface oxide layer formed on a surface thereof and containing oxygen less than 2.0%.

25. The method of claim 13, further comprising at least one selected from the group consisting of fine $SiO_2$ powder, alumina powder and alumina sol by 0.2-3.5 part by weight with respect to 100 part by weight of the Fe—Si-based composite compound sintered powder.

26. The method of claim 13, wherein the Fe—Si-based composite compound sintered powder substantially comprises $FeSi_2$, FeSi, $Fe_5Si_3$ or $Fe_3Si$, and comprises the sintered powder of $FeSi_2$+FeSi in excess of 90 wt % with respect to the weight of the Fe—Si-based sintered powder.

* * * * *

UNITED STATES PATENT AND TRADEMARK OFFICE

CERTIFICATE OF CORRECTION

PATENT NO. : 7,435,304 B2
APPLICATION NO. : 10/519227
DATED : October 14, 2008
INVENTOR(S) : Choi et al.

It is certified that error appears in the above-identified patent and that said Letters Patent is hereby corrected as shown below:

Column 4, Line 5, “non-homogenous” should read -- non-homogeneous --

Column 23, Line 2, Claim 20, “f the steel sheet” should read -- of the steel sheet --

Signed and Sealed this

Twenty-fourth Day of February, 2009

JOHN DOLL
*Acting Director of the United States Patent and Trademark Office*